US008784006B2

(12) United States Patent
Fyfe

(10) Patent No.: US 8,784,006 B2
(45) **Date of Patent: *Jul. 22, 2014**

(54) REINFORCEMENT SYSTEM FOR INCREASED LATERAL STABILITY OF WALL

(71) Applicant: Fyfe Co. LLC, San Diego, CA (US)

(72) Inventor: Edward R. Fyfe, San Diego, CA (US)

(73) Assignee: Fyfe Co., LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/952,172

(22) Filed: Jul. 26, 2013

(65) Prior Publication Data

US 2013/0309013 A1 Nov. 21, 2013

Related U.S. Application Data

(63) Continuation of application No. 12/806,925, filed on Aug. 24, 2010, now Pat. No. 8,496,404.

(51) Int. Cl.
*E02B 7/08* (2006.01)

(52) U.S. Cl.
USPC ..... 405/114; 405/107; 405/16; 405/284

(58) Field of Classification Search
USPC ..... 405/107, 114, 31, 15, 16, 17, 284, 285
See application file for complete search history.

(56) References Cited

U.S. PATENT DOCUMENTS

| | | | | |
|---|---|---|---|---|
| 2,128,681 | A * | 8/1938 | Logeman | 405/114 |
| 2,138,070 | A * | 11/1938 | Parkinson et al. | 405/114 |
| 2,961,731 | A * | 11/1960 | Buzzell et al. | 405/114 |
| 5,043,033 | A | 8/1991 | Fyfe | |
| 5,645,373 | A * | 7/1997 | Jenkins | 405/114 |
| 5,649,398 | A | 7/1997 | Isley, Jr. et al. | |
| 5,657,595 | A | 8/1997 | Fyfe et al. | |
| 5,993,113 | A * | 11/1999 | Darling | 405/114 |
| 6,460,304 | B1 * | 10/2002 | Kim | 52/408 |
| 6,746,741 | B2 * | 6/2004 | Wheatley | 428/40.1 |
| 6,846,537 | B2 * | 1/2005 | Wheatley et al. | 428/40.1 |
| 7,207,149 | B2 | 4/2007 | Fyfe et al. | |
| RE39,839 | E * | 9/2007 | Wheatley et al. | 156/71 |
| 7,303,358 | B1 * | 12/2007 | Fuller | 405/114 |
| 7,785,042 | B2 * | 8/2010 | Scandaliato | 405/284 |
| 7,886,651 | B2 * | 2/2011 | Hall | 52/309.1 |
| 8,496,404 | B1 * | 7/2013 | Fyfe | 405/114 |
| 2004/0098937 | A1 * | 5/2004 | Blake et al. | 52/302.6 |
| 2011/0033242 | A1 * | 2/2011 | Albrecht et al. | 405/108 |

OTHER PUBLICATIONS

Non Final Rejection in related U.S. Appl. No. 12/806,925 dated Jul. 6, 2012, 4 pages.

Final Rejection in related U.S. Appl. No. 12/806,925 dated Dec. 20, 2012, 6 pages.

* cited by examiner

*Primary Examiner* — Frederick L Lagman

(74) *Attorney, Agent, or Firm* — Senniger Powers LLP

(57) ABSTRACT

Reinforcement system for concrete panel wall, such as I-type flood wall, includes high tensile strength textile attached to wall by adhesive and reinforced by mechanical fasteners. Most preferred embodiment comprises a strip of fiber reinforced plastic spanning multiple panels, with the grain of the textile material extending horizontally. Alternative embodiment includes vertical FRP with bias-grain textile. Fasteners are preferably ductile fiber anchors.

19 Claims, 2 Drawing Sheets

REINFORCEMENT SYSTEM FOR INCREASED LATERAL STABILITY OF WALL

This application is a Continuation of U.S. Pat. No. 8,496,404, entitled REINFORCEMENT SYSTEM FOR INCREASED LATERAL STABILITY OF FLOOD WALL, the contents of which are incorporated herein by reference in their entirety for all purposes.

FIELD OF THE INVENTION

This invention relates generally to reinforcing a structure consisting of concrete panels, and more particularly to preventing known failure modes of existing flood walls.

BACKGROUND OF THE INVENTION

Flood walls are slim vertical walls that are placed around a structure, property, or portion of a city to protect the surrounded area from flooding. Concrete flood walls may be used to protect an area in which there is not room for the massive footprint of a dike or levee; flood walls are also sometimes constructed on top of existing dikes or levees for additional protection.

Conventional flood walls are typically constructed from concrete panels that are usually four to ten feet high and 25 feet wide. These concrete panels are installed end-to-end with a small gap between the ends of adjacent panels, to allow for thermal expansion. This gap is filled with an expansion joint, such as a hollow rubber strip. The panels are fixed into the ground in some manner.

One type of conventional flood wall is called the "I-type." The "I" refers to the shape of the wall's cross-section. The wall is generally slender in cross-section, possibly with a thicker section near the bottom. A sheet-like piling is embedded within each panel to fix the panels into the underlying earth.

To build an I-type flood wall (also called "I-wall"), the sheet pilings are first driven into the ground in a line. Concrete sheathing is cast in place over the pilings in sections, with narrow gaps between the sections, so as to form panels. If the flood wall were cast as a continuous length of concrete, internal stress from thermal expansion and contraction would lead to eventual cracking of the concrete.

The narrow gaps between panel, are filled by expansion joints. These are typically a strip of resilient material that is compressed or stretched as needed. Each expansion joint is attached to the panels on either side of the gap.

It has been found, such as in the flooding of New Orleans following Hurricane Katrina, that I-type walls are prone to catastrophic failure when the pressure from flood water is greater or more sudden than designed for, or if the water level overtops the flood wall and creates fluctuating forces as the water surges. Experience has shown that the concrete panels can deflect sufficiently to open up the expansion joints, allowing water to pour through. The mass of water spreads the gap and deflects the panel even further until the panel topples. Once one panel fails, it is wrenched out of place and starts a cascade of catastrophic failure along the flood wall.

Another reason for failure of I-type walls is if a portion of the soil supporting the I-type wall is too soft. The panels anchored in the soft soil tend to rotate away from the weight of flood water, opening a gap at the base of the I-type wall. Water enters the gap, further softening and scouring into the soil. This mechanism also leads to cascading failure of the flood wall.

Many of these I-type flood walls exist, because they appeared to be a cost-effective way to protect an area. Now that they have been shown to be less effective than expected, many cities and states are faced with expensive replacement, shoring up, or strengthening of their existing flood walls.

Another style of flood wall is called "T-type" because its cross-section resembles either an inverted letter "T" or an upright "L." The horizontal bar is buried beneath the supporting soil and helps the panels of the wall resist rotation away from the force of flood waters. T-type walls are stronger than I-type walls, but can still fail in similar ways under sufficient forces.

There is a great need for a relatively inexpensive and simple means to reinforce existing flood walls. Because flood walls were often chosen as the preferred means of flood protection due to limited space, there is a need for a reinforcement system that does not require extensive excavation to install on an existing wall and that does not greatly increase the footprint of the flood wall. There is a need for a reinforcement system and method that addresses the known failure mechanisms of flood walls and strengthens the existing I-type wall to equal other, more robust, types of flood walls.

Preferably, a reinforcement system should be fast and easy to install to avoid undue disturbance to residents or businesses in the area.

SUMMARY OF THE INVENTION

The present invention is a system and method for reinforcing flood walls, such as I-type walls or T-type walls, that consist of panels connected by expansion joints. The reinforcement system connects the panels together so that they cooperate to keep each other in position, even if a portion of the underlying soil is soft. The reinforcement system also helps seal the expansion joint against leakage, without impairing the function of the joint.

The reinforcement system of the present invention consists of three main elements: a continuous horizontal band of textile material attached lengthwise along the entire wall; mechanical anchors at intervals along the length of the horizontal strip of textile; and an additional cap of textile material wrapped over the upper edge of the flood wall in the region of the expansion joint. Optionally, a vertical strip of bias-cut textile is attached over the expansion joint.

The textile material is attached to the wall panels with an adhesive. The adhesive may be brushed, troweled, or sprayed onto the wall; the textile may be dipped in a liquid adhesive; or the textile may be pre-impregnated with an adhesive resin.

It should be noted that the present invention is largely intended as a system for reinforcing existing I-type or T-type flood walls that are for protecting a structure or area from flood water from an ocean, lake, river, or similar body of water, as well as ruptured pipes, tanks, and so on. Thus, the term "water" as used in the specification and claims should be understood to include salt water, flowing mud, water that contains other constituents such as petrochemicals or other materials that may contaminate flood water, or other fluids. The term "flood" should be understood to mean the presence of water or other liquid at an unusually high level or in an undesired location, whether as a result of a natural event, industrial accident, or other cause.

It is also envisioned that the present invention is equally beneficial as part of a newly-constructed flood protection wall.

The exemplary flood walls described herein are said to include expansion joints between adjacent panels. The present invention is equally beneficial for reinforcing other designs of walls that do not include expansion joints, with slight modification as will be obvious to one of skill in the art. In the broader sense, the term "joint" may be understood to mean an expansion joint or simply the joint where the ends of two panels abut or are close together, with or without interposed additional material.

DETAILED DESCRIPTION OF THE INVENTION

Figure 1:
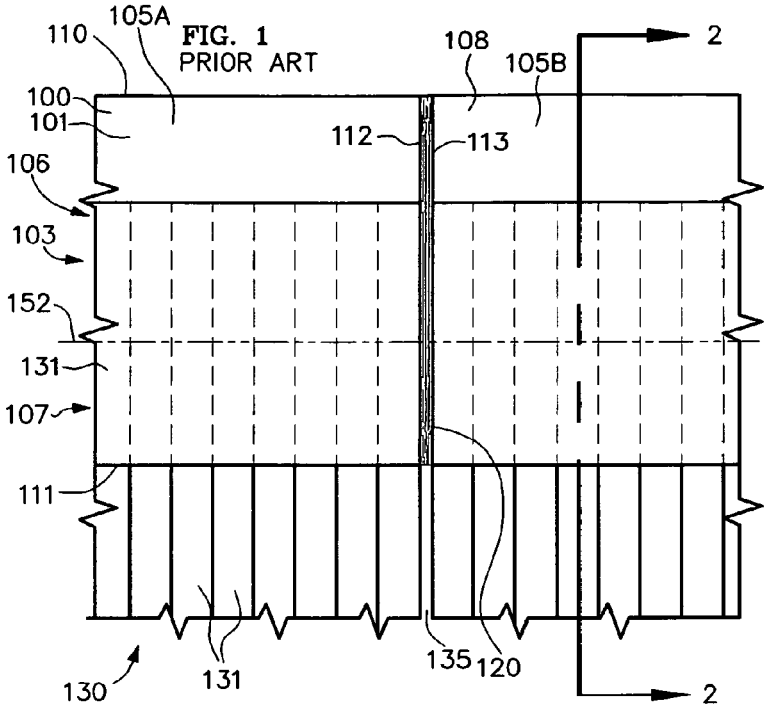
FIG. 1 PRIOR ART
FIG. 1 is a front elevation view of an exemplary PRIOR ART I-type flood wall, cut away at sides and bottom. In this view, soil is not shown but the eventual level to which soil will be backfilled is indicated by a dashed line.
Figure 2:
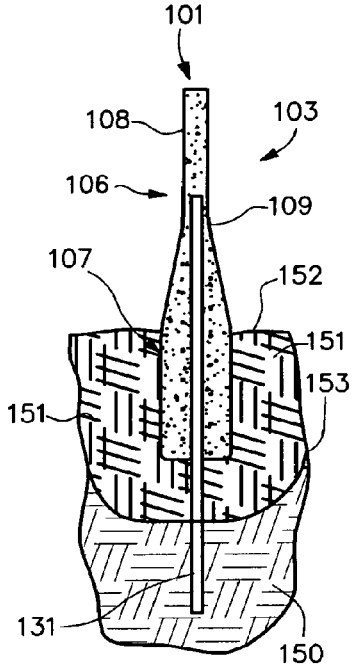
FIG. 2 PRIOR ART
FIG. 2 is a sectional view of the PRIOR ART wall of FIG. 1, taken along line 2-2. In this view, soil is shown backfilled around the base of the wall.

FIG. 1 is a front elevation view of a wall 100, such as a prior art I-type flood wall 101, cut away at sides and bottom. In this view, soil is not shown but the eventual level to which soil will be backfilled is indicated by a dashed line 152. FIG. 2 is a sectional view of flood wall 101 of FIG. 1, taken along line 2-2. In this view, soil 151 is shown backfilled around flood wall 101.

The typical process for constructing prior art flood wall 101 is to first excavate a trench in earth 150 along the planned path of flood wall 101, such as to excavation level 153 seen in FIG. 2. Pilings 130 are driven into earth 150, for example, the individual staves of sheet pilings 131 are sunk into earth 150 in a nearly continuous line. Small gaps 135 may be left between sheet pilings 131 to define gaps 135 between the eventual panels of flood wall 101 (as shown), or short pilings (not shown) may be installed at intervals for the same purpose.

A concrete cap 103 is cast in place over sheet pilings 131. To accommodate thermal movement of the concrete, small gaps are left at intervals. Each gap is filled with an expansion joint 120, typically a resilient strip that can stretch or compress to absorb strain, while also providing a water-tight seal between panels. Expansion joint 120 is typically one to two inches wide.

Concrete cap 103 can thus be seen to be made up of many individual sections, or panels 105; each panel 105 having an upper edge 110, a lower edge 111 in contact with the earth, a first end 112, and a second end 113. FIG. 1 further shows a first panel 105A and second panel 105B. First end 112 of first panel 105A is connected to second end 113 of second panel 105B by expansion joint 120. Second end 113 of first panel 105A and first end 112 of second panel 105B are cut away and are not shown. A typical length for panel 105 is 25 feet from first end 112 to second end 113.

Flood wall 101 may be constructed more or less in a single straight or curved line, as along a flood-prone portion of a river, or connecting to itself or to other walls 101 to enclose a low-lying area of land. In either case, there is generally a rear face 109, facing the expected direction of flood waters, and a front face 108, facing the area being protected.

The excavated level 153 is backfilled to backfill level 152, possibly with additional soil 151 brought in to form the desired grade. The backfilled soil 151 is preferably compacted as much as practical. Typically, a portion of concrete cap 103 ends up as buried portion 107, which is below backfill level 152. Exposed portion 106, above backfill level 152, most typically protrudes one to four feet above grade, but may be taller.

Although the substrate below flood wall 101 is herein generally referred to as soil 150, it should be understood to be whatever the native ground is, including soil 150, sand, clay, silt, gravel, or rock, for example. Because of variation in the nature and depth of various sorts of earth along the length of flood wall 101, even adjacent panels 105 may be anchored in substrates of greatly differing resistance to lateral forces. Differences in substrate may be compensated for somewhat by driving pilings deeper into softer substrates; but especially in the case of substrates that become fluid when saturated, deeper pilings are not a sufficient solution.

If flood water should rise against rear face 109 of flood wall 101, panels 105 optimally work together as if they were a single unit. Under loads that do not exceed the support capacity of the substrate, expansion joints 120 hold panels 105 together and prevent water from intruding through flood wall 101.

Failure of flood wall 101 may occur if one or more panels 105 have insufficient support from pilings 131. The poorly supported panel 105 may rotate away from the flood water while adjacent panels 105 remain relatively upright. This creates a tearing force along expansion joint 120, which it is not designed to withstand. To compound the problem, when a panel 105 rotates away from the force of the water, a gap in soil 150 may open to the rear (water side) of exposed portion 106. This gap allows water to penetrate quickly into the already-soft substrate, possibly softening it further or scouring it away. Pilings 131 may become largely exposed on the rear side, removing their ability to support panel 105 upright.

When panels 105 are sufficiently attached to each other, as by the reinforcement system of the present invention, applied forces are "averaged out" over many panels 105 such that a single panel 105 does not experience far greater forces than adjacent panels 105. Panels 105 are thus maintained with upper edges 110 generally co-linear such that panels 105 remain connected together by expansion joint 120 and are united in preventing inflow of flood water into the protected area.

Figure 3:
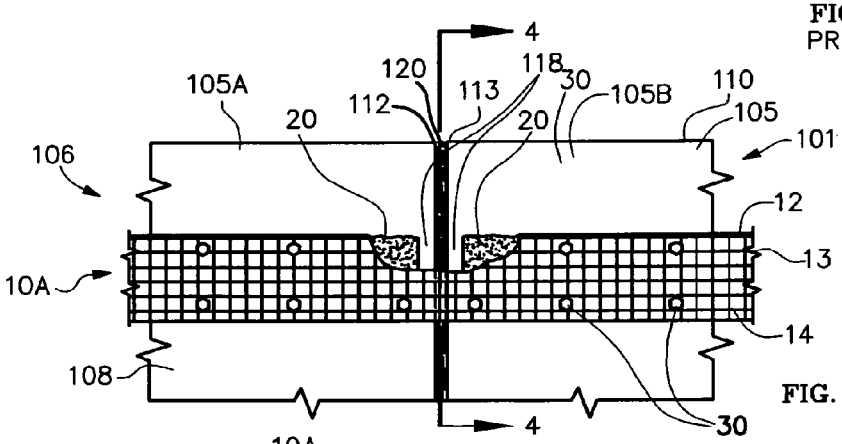
FIG. 3 is a front elevation view of a first preferred embodiment of the reinforcement system of the present invention, in combination with the prior art wall of FIG. 1, partly cut away.
Figure 4:
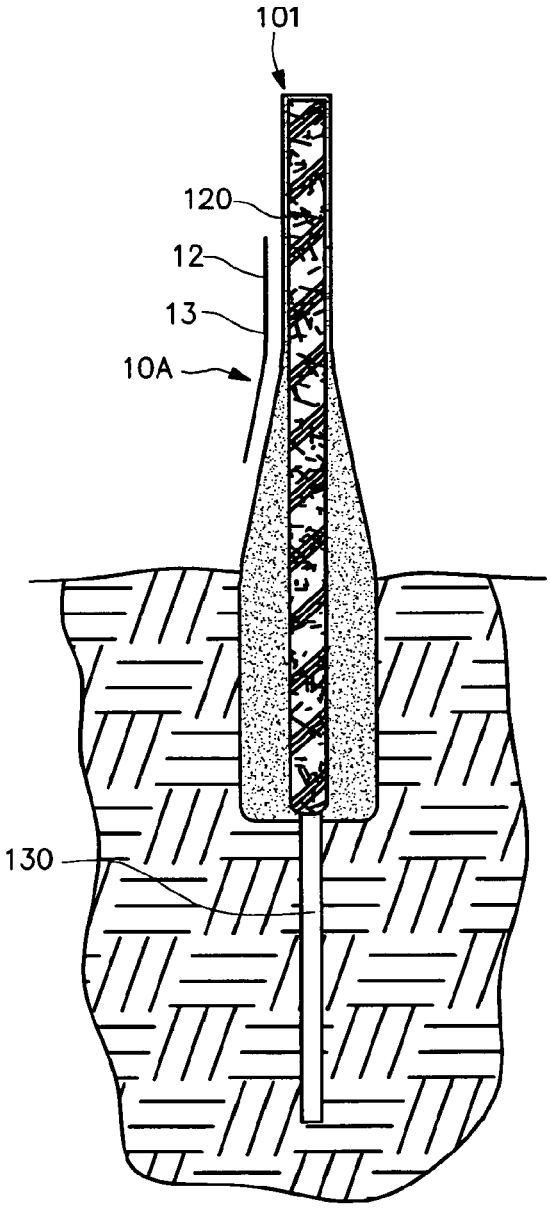
FIG. 4 is a sectional view of the wall and first preferred embodiment of the reinforcement system of FIG. 3, taken along line 4-4 and partly exploded.

FIG. 3 is a front elevation view of a first preferred embodiment 10A of the reinforcement system 10 of the present invention, in combination with the prior art flood wall 101 of FIG. 1, partly cut away. FIG. 4 is a sectional view of wall 101 and first preferred embodiment 10A of the reinforcement system 10 of FIG. 3, taken along center line 4-4 and partially exploded to show strip 12 in position for attachment.

Reinforcement system 10A comprises a first horizontal strip 12 of suitable sheet material, such as woven fabric 13, a plurality of fasteners 30, and adhesive 20 attaching first strip 12 to front face 108 of flood wall 101. In FIG. 3, first strip 12 is shown partly cut away over expansion joint 120 to show adhesive 20.

First strip 12 is composed of a suitable sheet material that has high tensile strength and ductility; excellent resistance to outdoor environmental conditions; and is preferably strongest in the direction parallel to upper edge 110 of flood wall 101. An engineering textile, such as a woven fabric 13 manufactured from yarns such as graphite carbon, fiberglass, or others know in the art, is a cost-effective choice, although other materials could also be employed.

Woven fabric 13 and adhesive 20 may be combined as strips 14 of resin-impregnated fabric (pre-preg), also known as fiber-reinforced plastic (FRP). FRP is well known in the structure reinforcement field and is a flexible material that can be cut or drilled. The included adhesive resin is in a gelled state that is not very sticky and hardens over a period of hours or days at ambient temperature.

A length of fabric 13 is attached to flood wall 101, typically to front face 108, using a suitable adhesive selected for environmental durability and excellent resistance to peel and shear forces, as is well known in the art. Woven fabric is known to have greatest tensile strength along its "grain," which is usually the direction of the warp. Therefore, first strip 12 of fabric 13 should be prepared such that the grain is parallel to the centerline of first strip 12, and attached to flood wall 101 with the grain parallel to the length of flood wall 101.

To clarify this point in the illustration, first strip 12 of fabric 13 is depicted as a narrow band in FIG. 3, obviously having a horizontal grain. Fabric 13 may be relatively wider, in fact, may be wide enough to cover the entire exposed portion 106 of front face 108. In this case, fabric 13 must still be attached to front face 108 with the grain horizontal and parallel to upper edge 110.

Fabric 13 is preferably not attached to expansion joint 120 with adhesive 20, although fabric 13 does overlie expansion joint 120. If adhesive 20 is applied to front face 108 such as by rolling or brushing, an adhesive-free unbonded zone 118 should be left bare near expansion joint 120. For example, a vertical strip of fabric 13 one to three inches wide might be left unbonded over and adjacent to expansion joint 120.

If adhesive 20 is already applied to fabric 13 such as by wet-dipping, or resin impregnation in the case of FRP 14, the unbonded zone over and adjacent to expansion joint 120 may be rendered functionally adhesive-free by inserting a "slip sheet" of release paper or plastic of the required width, as is well known in the art, over expansion joint 120 before attaching fabric 13 to front face 108.

Because fabric 13 is not attached to expansion joint 120, expansion joint 120 is free to flex due to temperature changes without tearing fabric 13 loose from front face 108. The portion of fabric 13 above unbonded zone 118 can stretch sufficiently to accommodate expansion of expansion joint 120. The required width of unbonded zone 118 can be calculated by comparison of the potential thermal expansion of expansion joint 120 to the measured elongation characteristics of the specific fabric 13 used.

To reinforce the adhesive attachment of fabric 13 to front face 108, mechanical fasteners 30 are installed at intervals along the edges of fabric 13. Fasteners 30 may, for example, be metal bolts or ductile fiber anchors that pass through fabric 13 and into panel 105 via drilled holes. Fasteners 30 may alternatively include elements, such as segments of steel rebar, that were cast in place when panel 105 was created.

In the case of fabric 13 being attached by a separate adhesive 20 applied to front face 108, it may be beneficial to apply an optional top coat (not shown) over fabric 13 to fill any remaining porosity of fabric 13 and create a smooth finish for reinforcement system 10. In the case of fabric 13 being FRP strip 14, that is, fully impregnated with resin and not porous, optional top coat may still be applied for the purpose of uniformity of color or increased environmental resistance. The optional top coat may be a polymer resin, paint, or a cementitious plaster, for example.

Reinforcement system 10A has been found be successful in maintaining the cooperation of all panels 105 in a unitary flood wall 101. Keeping panels 105 aligned protects expansion joints 120 against rupture or being torn away from a panel 105 and helps prevent a single panel 105 from toppling and creating a gap in wall 101.

Figure 5:
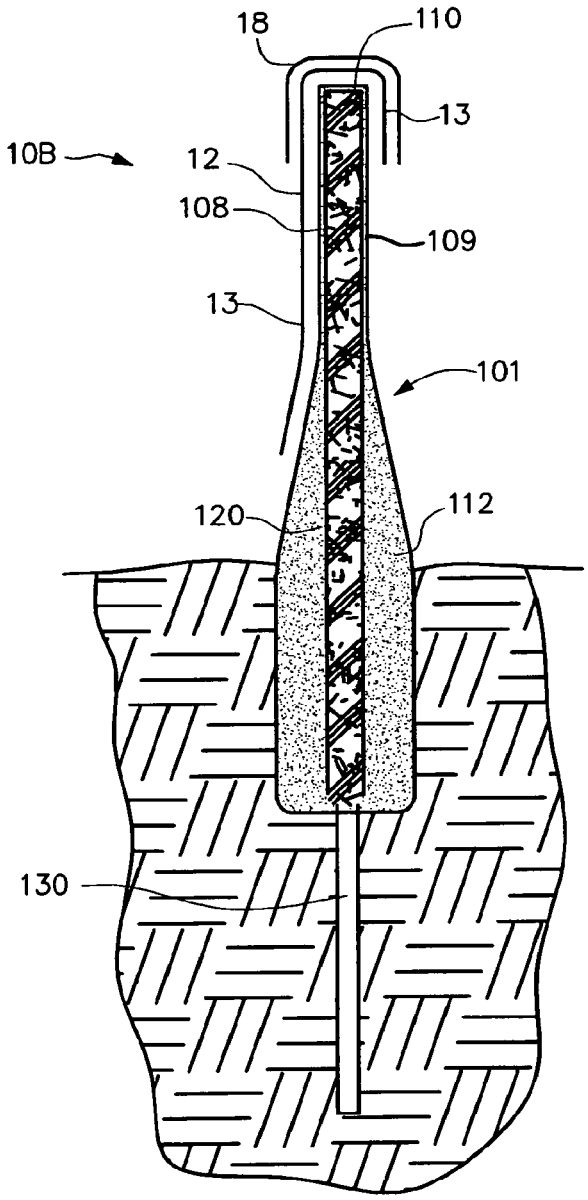
FIG. 5 is likewise a sectional view of a second preferred embodiment of the present invention, partly exploded. No corresponding front elevation view is shown.

FIG. 5 is a sectional view of second preferred embodiment 10B, partly exploded. No corresponding front elevation view is shown. Reinforcement system 10B is a modification of system 10A. Reinforcement system 10B is more expensive to install but provides a greater increase in the strength of flood wall 101.

Reinforcement system 10B is similar to system 10A, but with a portion of fabric 13 wrapped over upper edge 110 of flood wall 101 and spanning expansion joint 120 so as to better connect adjacent panels 105A, B. The portion of fabric 13 that wraps over upper edge 110 and onto rear face 109 may be the uppermost portion of first strip 12 or it may be a separate piece of fabric 13, as shown in FIG. 5 as cover strip 18, or both. The portion of fabric 13 that wraps onto rear face 109 is attached with adhesive 20, as described in the discussion of first embodiment 10A. Adhesive 20 is applied to upper edge 110 and rear face 109 with inclusion of an adhesive-free strip 118, as also described above.

Figure 6:
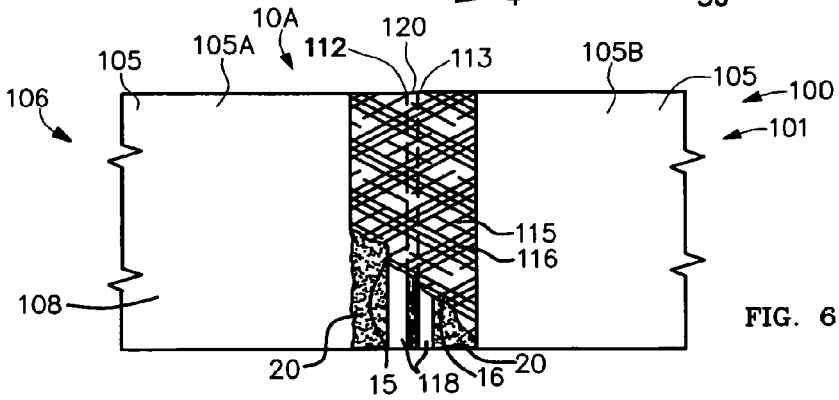
FIG. 6 is a front elevation view of a third preferred embodiment of the invention in combination with the prior art wall of FIG. 1, partly cut away.

FIG. 6 is a front elevation view of a third preferred embodiment 10C of the present invention in combination with the prior art wall of FIG. 1, partly cut away. FIG. 6 is a front elevation view of a third preferred embodiment 10C of the invention in combination with the prior art wall of FIG. 1, partly cut away. Reinforcement system 10C comprises a vertical strip of sheet material 15. Sheet material 15 must have high tensile strength and ductility; and excellent resistance to outdoor environmental conditions. An engineering textile, such as a woven fabric 16 manufactured from yarns such as graphite carbon, fiberglass, or others know in the art, is a cost-effective choice, although other materials could also be employed.

In contrast to fabric 13 of embodiment 10A discussed above, fabric 16 preferably has a bias grain, that is, the grain is at an angle of approximately 45 degrees to the vertical centerline of fabric 16. Such a strip of fabric 16 is typically prepared by cutting a roll of fabric into short diagonal strips, then connecting the strips end-to-end into a longer bias-grain length of fabric 16. Bias grain fabric is well known in the textile field.

Fabric 16 is attached to exposed portion 106 of front face 108 with adhesive 20, as described above. As with embodiment 10A, a strip of front face 108 near expansion joint 120 is left free of adhesive, either by non-application or by insertion of a slip sheet.

The width of fabric 16 is typically four to six feet, but is specifically determined by the needs of wall flood wall 101. Mechanical fasteners 30 may be included, but their contribution to the total strength of reinforcement system 10C is less than for system 10A.

A fourth embodiment 10D, not specifically illustrated, is a combination of a first horizontal straight-grain fabric strip 13 spanning multiple panels 105 as in FIG. 3, with a second bias-grain fabric strip 16 attached over each expansion joint 120 as in FIG. 6, and crossing first fabric strip 13.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. In combination:

a wall including:

a plurality of upright panels; each said panel including:

an outer face;

an inner face opposite said outer face;

two ends;

a lower edge;

an upper edge;

said panels being connected end to end; and an expansion joint disposed between and connecting adjacent ends of said panels; and a reinforcement system to strengthen said wall, comprising:

a first strip of sheet material adhesively attached horizontally along the length of said wall such that said strip is attached to a portion of one of said outer and inner faces of each of said plurality of panels, said first strip of sheet material covering but not adhesively attached to said expansion joint.

2. The combination of claim 1, said attached first strip of sheet material comprising:

a length of fabric woven from yarns of suitable strength and durability; disposed between said lower and upper edges such that the grain of said length of fabric is parallel to said upper edge.

3. The combination of claim 1, said reinforcement system further including:

a plurality of mechanical fasteners attaching said first strip of sheet material to said panels.

4. The combination of claim 1, said first strip of sheet material being not adhesively attached to said one of said outer and inner faces of at least one said panel near said expansion joint such that said first strip of sheet material includes:

an unbonded portion covering said expansion joint; said unbonded portion being sufficiently wider than said expansion joint such that said unbonded portion can stretch sufficiently to accommodate flexing of said joint due to thermal expansion and contraction of said panels connected to said expansion joint.

5. The combination of claim 1, further including:

a second strip of sheet material vertically spanning the joint between a first said panel and a second said panel; said strip attached to a portion of one said face of said first panel and a portion of one said face of said second panel and comprising:

a length of fabric woven from yarns of suitable strength and durability; disposed such that the vertical centerline of said length of fabric is parallel to said expansion joint and the grain of said fabric is an angle of 20 to 70 degrees from parallel to said expansion joint.

6. In combination:

a wall including:

a plurality of upright panels; each said panel including:

an outer face;

an inner face opposite said outer face;

two ends;

a lower edge; and an upper edge;

said panels being disposed end to end; and expansion joints connecting adjacent pairs of panels, each said expansion joint being disposed between one said end of a first said panel and the adjacent said end of an adjacent second said panel for resiliently sealing the gap between said panels; and a reinforcement system to strengthen said wall, comprising:

a first strip of sheet material vertically spanning the gap between a first said panel and a second said panel; said strip attached to a portion of one of said outer and inner faces of said first panel and a portion of one of said outer and inner faces of said second panel; said strip covering but not attached to said expansion joint between said first and second panels, such that said attached strip does not interfere with the function of said expansion joint.

7. The combination of claim 6, said first strip of sheet material attached to said one of said outer and inner faces of each said panel by a suitable adhesive; but not attached to said expansion joint.

8. The combination of claim 6, said first strip of sheet material comprising:

a length of fabric woven from yarns of suitable strength and durability; disposed such that the vertical centerline of said length of fabric is parallel to said expansion joint and the grain of said fabric is at an angle of 20 to 70 degrees from parallel to said expansion joint.

9. The combination of claim 6, said reinforcement system further including:

a second strip of sheet material attached horizontally along the length of said wall such that said strip spans at least a portion of each of said plurality of panels.

10. The combination of claim 9, said second strip of sheet material attached to said one of said outer and inner faces of each said panel by a suitable adhesive; but not attached to said expansion joint and not interfering with the function of said expansion joint.

11. The combination of claim 9, said second strip of sheet material comprising:

a length of fabric woven from yarns of suitable strength and durability; disposed between said lower and upper edges such that the grain of said length of fabric is parallel to said upper edge.

12. The combination of claim 9, said reinforcement system further including:

a plurality of mechanical fasteners connecting said second strip of sheet material to said panels.

13. In combination:

a wall including:

a first panel including:

a first end;

an upper edge; and a lower edge;

a second panel including:

a second end;

an upper edge; and a lower edge;

said first panel and said second panel disposed with said first end and said second end opposed and close to each other; and an expansion joint disposed between said first and second ends and connecting said ends together; and a reinforcement system for increasing the lateral stability of said wall, including:

at least one sheet of textile material adhesively attached to both said first panel and said second panel and not attached to said expansion joint.

14. The combination of claim 13, said at least one sheet of textile material comprising:

a sheet of fabric woven from yarns of suitable strength and durability; disposed between said lower and upper edges such that the grain of said length of fabric is generally parallel to said upper edges of said panels.

15. The combination of claim 13, said at least one sheet of textile material comprising:

a first sheet of fabric woven from yarns of suitable strength and durability; disposed such that the grain of said fabric is at an angle of 20 to 70 degrees from parallel to said expansion joint.

16. The combination of claim 15, said at least one sheet of textile material further including:

a second sheet of fabric woven from yarns of suitable strength and durability; disposed between said lower and upper edges such that the grain of said length of fabric is generally parallel to said upper edge.

17. The combination of claim 13; wherein said at least one sheet of textile material comprises: at least one panel of fiber-reinforced plastic.

18. The combination of claim 13; said reinforcement system further including:

a plurality of mechanical fasteners for attaching said at least one sheet of textile material to said first and second sections.

19. The combination of claim 13, said sheet of textile material being not adhesively attached to said first and second panels near said opposing first and second ends of said panels, such that said attached sheet of textile material includes:

an unbonded portion covering said expansion joint; said unbonded portion being sufficiently wider than said expansion joint such that said unbonded portion can stretch sufficiently to accommodate flexing of said joint due to thermal expansion and contraction of said first and second panels connected by said expansion joint.

* * * * *